US009042774B2

(12) United States Patent
Nittani

(10) Patent No.: US 9,042,774 B2
(45) Date of Patent: May 26, 2015

(54) CARTRIDGE AND IMAGE FORMING APPARATUS

(71) Applicant: CANON KABUSHIKI KAISHA, Tokyo (JP)

(72) Inventor: Susumu Nittani, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/675,835

(22) Filed: Nov. 13, 2012

(65) Prior Publication Data

US 2013/0121724 A1 May 16, 2013

(30) Foreign Application Priority Data

Nov. 15, 2011 (JP) ..... 2011-249920

(51) Int. Cl.
*G03G 21/18* (2006.01)
*G03G 15/08* (2006.01)

(52) U.S. Cl.
CPC ..... *G03G 15/0891* (2013.01)

(58) Field of Classification Search
CPC ..... G03G 2215/0822; G03G 2215/0838; G03G 2215/0607; G03G 2215/0827; G03G 21/1821; G03G 15/0832
USPC ..... 399/111, 119
See application file for complete search history.

(56) References Cited

U.S. PATENT DOCUMENTS

| | | | | |
|---|---|---|---|---|
| 5,493,366 | A * | 2/1996 | Satoh et al. | 399/111 |
| 2008/0205940 | A1* | 8/2008 | Mase et al. | 399/263 |
| 2009/0035028 | A1* | 2/2009 | Itabashi | 399/286 |
| 2010/0329747 | A1* | 12/2010 | Kouda | 399/262 |
| 2011/0064481 | A1* | 3/2011 | Ishiguro et al. | 399/263 |

FOREIGN PATENT DOCUMENTS

| | | | |
|---|---|---|---|
| JP | 11-160985 | A | 6/1999 |
| JP | 2010-014890 | A | 1/2010 |

* cited by examiner

*Primary Examiner* — Billy Lactaoen
*Assistant Examiner* — Arlene Heredia Ocasio
(74) *Attorney, Agent, or Firm* — Canon USA Inc. IP Division

(57) ABSTRACT

A cartridge attachable/detachable to/from a main assembly of an image forming apparatus, the cartridge includes a developer storage unit configured to store developer, a partitioning member movably provided inside the developer storage unit and configured to partition the developer storage unit, a developer conveyance member configured to convey the developer stored in the developer storage unit, and an operated portion configured to move the partitioning member, wherein when the cartridge is attached to the main assembly, the operated portion is moved by touching the main assembly to move the partitioning member from a first position to a second position where the developer storage unit is caused to be greater in capacity than that in the first position.

14 Claims, 12 Drawing Sheets

CARTRIDGE AND IMAGE FORMING APPARATUS

BACKGROUND OF THE INVENTION

1. Field of the Invention

The present invention relates to an image forming apparatus and a cartridge attachable/detachable to/from the image forming apparatus.

The term image forming apparatus refers to an apparatus for forming an image on a recording medium. For example, an electrophotographic copying machine, an electrophotographic printer (such as a light emitting device (LED) printer and a laser beam printer), and an electrophotographic facsimile apparatus which use an electrophotographic image forming process are included in the image forming apparatus.

The term recording medium refers to a medium on which an image is formed. For example, a recording sheet and an overhead projector (OHP) sheet are included in the recording medium.

The term cartridge refers to a cartridge in which a part of a mechanism used in the image forming apparatus is made attachable/detachable from the main assembly of the image forming apparatus.

2. Description of the Related Art

Now, an image forming apparatus usually employs a process cartridge system in which an electrophotographic photosensitive member and a process unit acting thereon are integrated into a cartridge attachable/detachable to/from the main assembly of the image forming apparatus. The process cartridge system is useful for improving operability of the image forming apparatus because a user can perform maintenance of the image forming apparatus.

A process cartridge is formed of a cleaning unit and a developing unit. The cleaning unit includes a cleaning member for cleaning an electrophotographic photosensitive drum acting as an image bearing member and the surface thereof. The developing unit includes a developing roller for supplying developer to the electrophotographic photosensitive drum and a developer storage unit for storing developer.

Meanwhile, a developer replenishment system is known as one of the process cartridge system. The system is configured in such a manner that the developer replenishment opening of a developer replenishment cartridge is connected with the developer acceptance opening of the process cartridge to replenish developer from the developer replenishment cartridge to the process cartridge.

In the developer replenishment system, if a new developer replenished from the developer replenishment cartridge is non-uniformly mixed with an old developer in the developing unit, harmful effects on images may occur. For this reason, the process cartridge of the developer replenishment system is provided with the following configuration (refer to FIG. 4 in Japanese Patent Application Laid-Open No. 2010-014890).

The development unit is divided into a development portion and a developer storage portion. The development portion and the developer storage portion are connected with each other through openings provided at both ends in the direction of the rotation axis of a developer photosensitive drum (hereinafter referred to as "longitudinal direction").

Each of the development portion and the developer storage portion is provided with a screw acting as a developer conveyance member for conveying a developer and sheet member acting as a developer stirring member. The developer conveyance member and the developer stirring member convey the developer in the longitudinal direction. The developer is thus circulated in the development unit to uniformly mix a new and an old developer therein.

In general, an unused process cartridge is filled with a predetermined amount of developer. The developer in the developer storage portion of the unused process cartridge is sometimes pressed and coagulated by vibration generated when the developer is transported from a manufacture place to a user.

In particular, if the longitudinal direction of the process cartridge is oriented in parallel with the vertical direction and the downstream side in the conveyance direction of the developer conveyance member is oriented downward during the transportation, the developer is sometimes accumulated on the downstream side in the conveyance direction of the developer conveyance member and coagulated.

In this state, when driving force is transmitted in the image forming apparatus, the developer conveyance member is rotated to convey the developer and the coagulated developer is further pressed on the downstream side in the conveyance direction. The load torque of the developer conveyance member may probably be increased.

Japanese Patent Application Laid-Open No. 11-160985 discusses a configuration, as a solution for the above problem, in which a clutch is provided on a drive gear train of the developer stirring member and the developer conveyance member as illustrated in FIG. 1 thereof.

The above configuration is such that, if the developer stirring member and the developer conveyance member are driven by the same drive source and the drive source is overloaded, the rotation of the developer conveyance member is stopped and only the developer stirring member is rotated.

SUMMARY OF THE INVENTION

The present invention is directed to a cartridge and an image forming apparatus capable of stably driving a developer conveyance member by reducing the coagulation of the developer when the use of the cartridge storing the developer is started.

According to an aspect of the present invention, a cartridge attachable/detachable to/from a main assembly of an image forming apparatus, the cartridge includes a developer storage unit configured to store developer, a partitioning member movably provided inside the developer storage unit and configured to partition the developer storage unit, a developer conveyance member configured to convey the developer stored in the developer storage unit, and an operated portion configured to move the partitioning member, wherein when the cartridge is attached to the main assembly, the operated portion is moved by touching the main assembly to move the partitioning member from a first position to a second position where the developer storage unit is caused to be greater in capacity than that in the first position.

According to another aspect of the present invention, an image forming apparatus for forming an image on a recording medium including a cartridge attachable/detachable to/from a main assembly of the image forming apparatus, the cartridge includes a developer storage unit configured to store developer, a partitioning member movably provided inside the developer storage unit and configured to partition the developer storage unit, a developer conveyance member configured to convey the developer stored in the developer storage unit, and an operated portion configured to move the partitioning member, and an operation portion, provided on the main assembly, which is operated in contact with the operated portion when the cartridge is attached to the main assembly, wherein the operated portion is moved by touching the operation portion, and the partitioning member is moved from a first position to a second position where the developer storage unit is caused to be greater in capacity than that in the first position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A process cartridge and a color image forming apparatus using a developer replenishment cartridge according to an exemplary embodiment of the present invention are described below with reference to the accompanied drawings.

Figure 2:
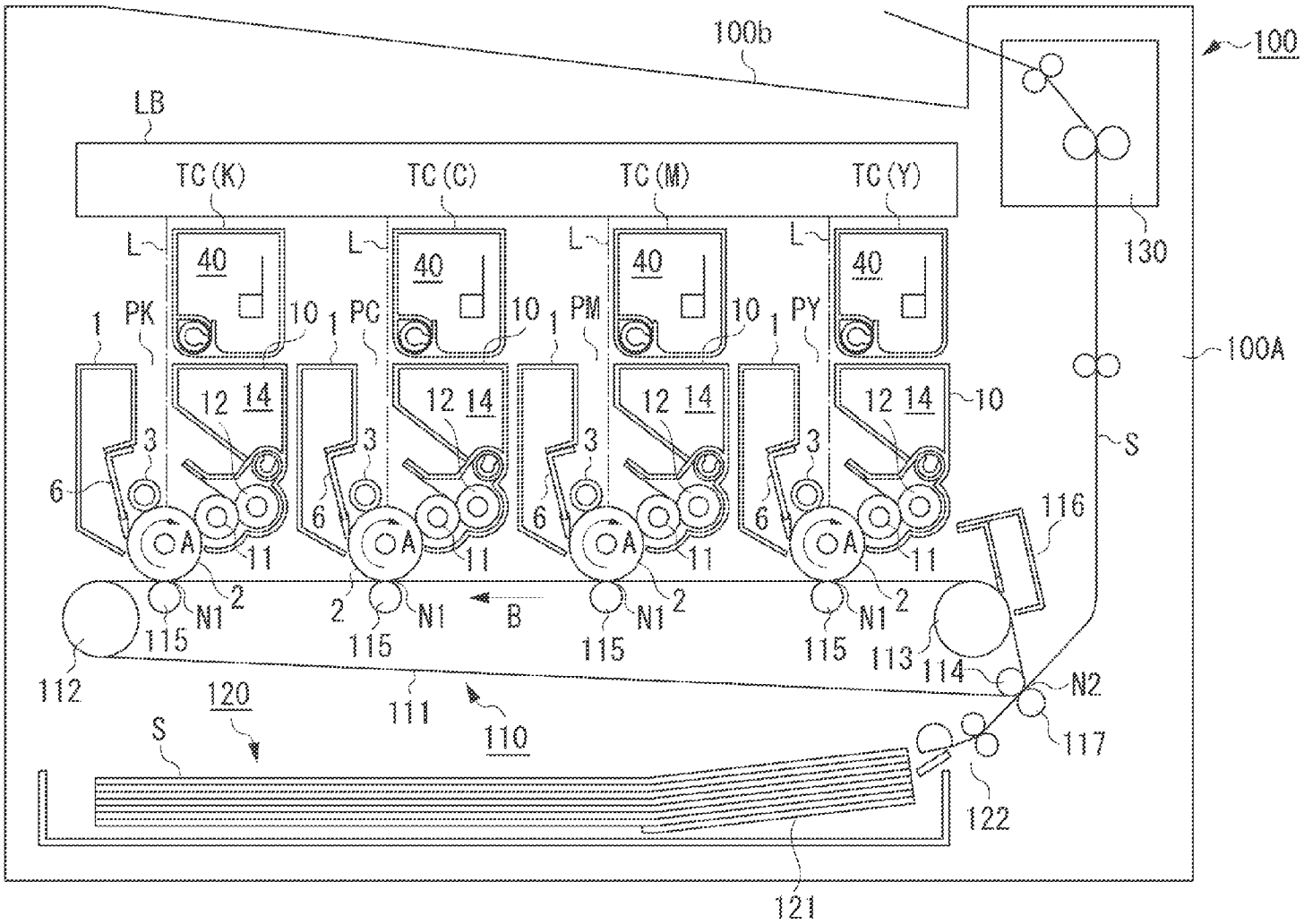
FIG. 2 is a schematic cross sectional view illustrating a color electrophotographic image forming apparatus according to the present exemplary embodiment.
Figure 3:
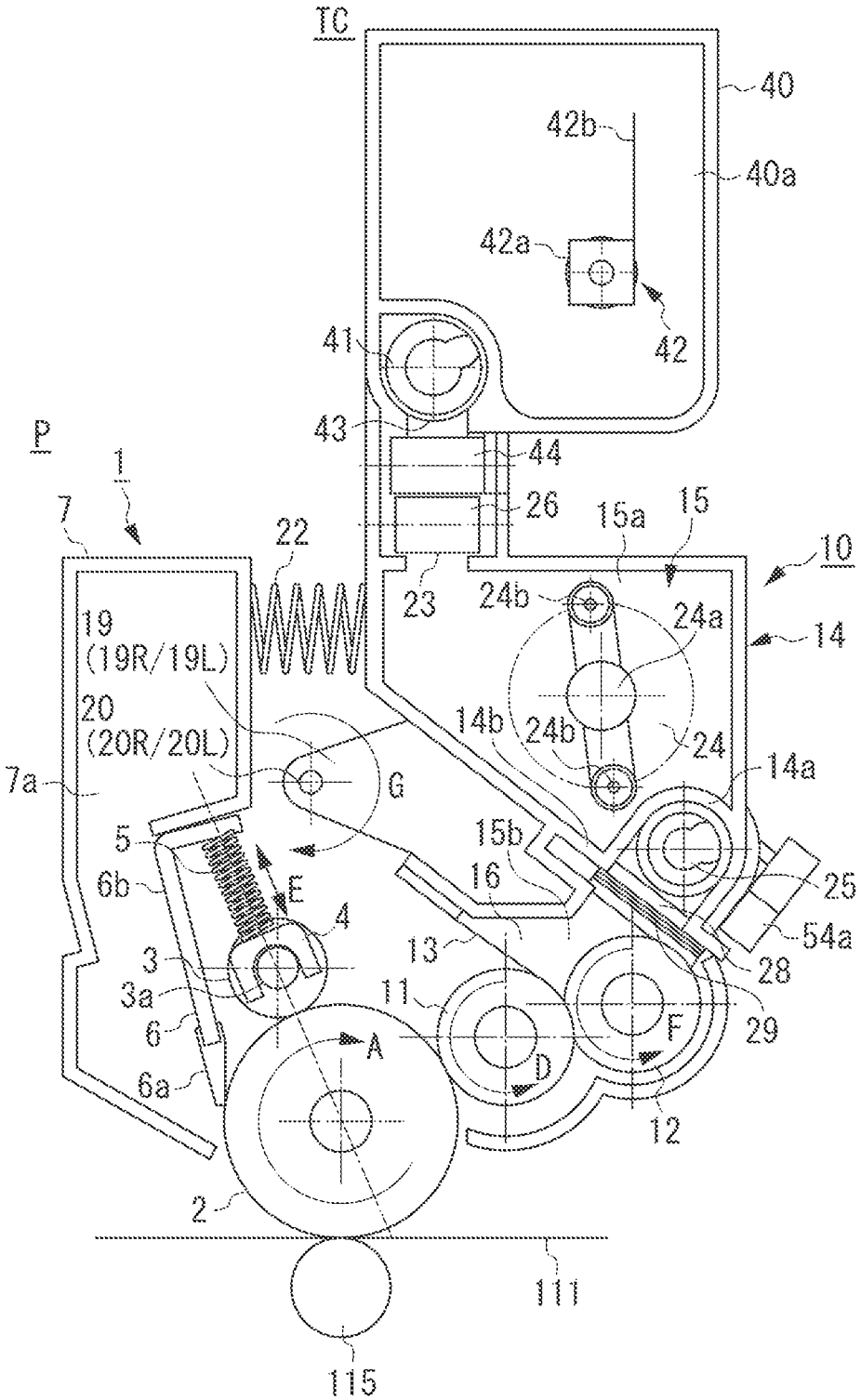
FIG. 3 is a main cross sectional view of a process cartridge and a developer replenishment cartridge according to the present exemplary embodiment.

An overall configuration of the image forming apparatus is described below with reference to FIGS. 2 and 3. FIG. 2 is a schematic cross sectional view illustrating a color electrophotographic image forming apparatus. FIG. 3 is a main cross sectional view illustrating the process cartridge and the developer replenishment cartridge.

An image forming apparatus 100 illustrated in FIG. 2 is a four-full-color laser beam printer using an electrophotographic image forming process and forms a color image on a recording medium S. The image forming apparatus 100 uses the process cartridge system. In this system, a process cartridge P and a developer replenishment cartridge TC is detachably attached to an image forming main assembly 100A and forms a color image on a recording medium S.

In the following description, the term image forming main assembly (herein after referred to as "main assembly") refers to a portion where the process cartridge P and the developer replenishment cartridge TC are removed from the configuration of the image forming apparatus.

In a main assembly 100A, there are arranged a first to a fourth process cartridges P (PY, PM, PC, and PK) and a developer replenishment cartridges TC (TC(Y), TC(M), TC(C), and TC(K)) side by side in the horizontal direction. Each of the process cartridges P and the developer replenishment cartridges TC has the same electrophotographic image forming process mechanism. The developers are different in color and filling amount from one another.

Rotational driving force is transmitted from the main assembly 100A to the process cartridge P and the developer replenishment cartridge TC. Bias (such as charging bias and developing bias) is applied from the main assembly 100A to the process cartridge P. The process cartridge P and the developer replenishment cartridge TC are independently detachable from the main assembly 100A.

Each of the process cartridges P according to the present exemplary embodiment is formed of a cleaning unit 1 and a developing unit 10 as illustrated in FIG. 3. The cleaning unit 1 includes an electrophotographic photosensitive drum (hereinafter referred to "photosensitive drum") 2 as an image bearing member, a charging roller 3 acting on the photosensitive drum 2, and a cleaning member 6.

The developing unit 10 includes developing means for developing an electrostatic latent image on the photosensitive drum 2. The cleaning unit 1 and the developing unit 10 are swingably connected with each other.

The first process cartridge PY stores yellow (Y) developer in a developer storage unit 15 being a part of a development container 14 and forms a yellow (Y) developer image on the photosensitive drum 2. Similarly, the second, the third, and the fourth process cartridge PM, PC, and PK store magenta (M), cyan (C), and black (K) developers, respectively.

The first developer replenishment cartridge TC(Y) stores yellow (Y) developer in a replenishment frame member 40 and replenishes the process cartridge PY storing the developer in the same color with the yellow (Y) developer. Similarly, developer replenishment cartridges TC(M), (C), and (K) store magenta (M), cyan (C), and black (K) developers, respectively.

The developer replenishment cartridges TC(M), (C), and (K) replenish the process cartridges PM, PC, and PK storing the developers in the same colors with the developers, respectively.

Figure 4:
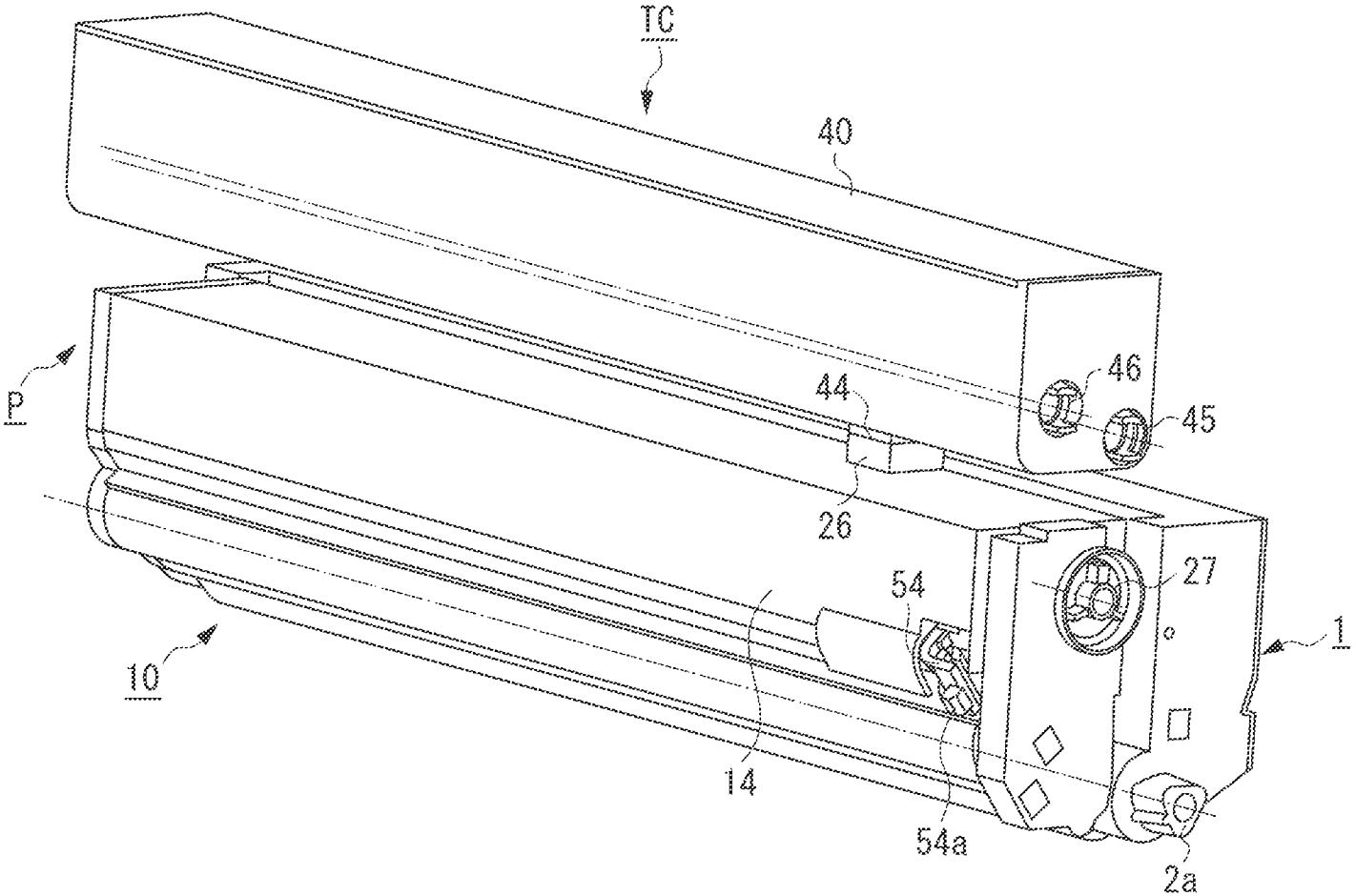
FIG. 4 is a general perspective view of the process cartridge and the developer replenishment cartridge in an image forming apparatus according to the present exemplary embodiment.

As illustrated in FIG. 4, the replenishment frame member 40 of the developer replenishment cartridge TC is provided with a developer replenishment opening 43 for replenishing the process cartridge P with developer. The developer storage unit 15 of the process cartridge P is provided with a developer acceptance opening 23 corresponding to the developer replenishment opening 43.

When the process cartridge P and the developer replenishment cartridge TC are attached to the main assembly 100A, the developer replenishment opening 43 communicates with the developer acceptance opening 23, the developer replenishment cartridge TC replenishes the process cartridge P with the developer.

The process cartridge P and the developer replenishment cartridge TC are described in detail below.

As illustrated in FIG. 2, a laser scanner unit LB as an exposure unit is disposed above the process cartridge P (PY, PM, PC, and PK). The laser scanner unit LB emits a laser beam L corresponding to image information. The laser beam L scans and exposes the surface of the photosensitive drum 2.

An intermediate transfer belt 110 as a primary transfer member is provided below the process cartridge P (PY, PM, PC, and PK). The intermediate transfer belt 110 includes an endless flexible transfer belt 111, a drive roller 112 for stretching and rotating the transfer belt 111, a driven roller 113, and a secondary transfer counter roller 114.

The photosensitive drum 2 of each of the process cartridges P contacts the transfer belt 111. A contact portion N1 between the photosensitive drum 2 and the transfer belt 111 is a primary transfer portion. A primary transfer roller 115 is provided opposing the photosensitive drum 2 inside the transfer belt 111. A secondary transfer roller 117 as a secondary transfer member is arranged in a position opposing the secondary transfer counter roller 114. A contact portion N2 between the transfer belt 111 and the secondary transfer roller 117 is a secondary transfer portion.

A feeding unit 120 is provided below the intermediate transfer belt 110. The feeding unit 120 includes a feeding tray 121 storing a recording medium S and a feed roller 122.

A fixing unit 130 is provided upper portion within the main assembly 100A. A discharge tray 100*b* is provided on the upper surface of the main assembly 100A.

A full-color image forming operation is described below with reference to FIG. 2. FIG. 2 is a schematic cross sectional view illustrating a color electrophotographic image forming apparatus.

The full-color image forming operation is as follows. The photosensitive drums 2 of the first to fourth process cartridges PY, PM, PC, and PK are driven and rotated at a predetermined speed in the direction indicated by an arrow A in FIG. 2. The transfer belt 111 is driven and rotated in the direction indicated by an arrow B (in the forward direction with respect to the rotation of the photosensitive drum 2). At this point, the speed of the transfer belt 111 corresponds to that of the photosensitive drums 2. The laser scanner unit LB is driven at the same time.

The charging roller 3 of each process cartridge P uniformly charges the surface of the photosensitive drums 2 at a predetermined polarity and electric potential in synchronization with the drive of the laser scanner unit LB. The laser scanner unit LB scans and exposes the surface of each photosensitive drum 2 with the laser beam L according to the image signal of each color.

This forms an electrostatic latent image on the surface of each photosensitive drum 2 according to the image signal corresponding to each color. The formed electrostatic latent image is developed by a developing roller 11. The developing roller 11 is a developer bearing member for carrying a developer (toner) for developing an electrostatic latent image.

The above image forming operation forms a Y-color developer image on the photosensitive drum 2 of the first process cartridge PY. The Y-color developer image is primary-transferred onto the transfer belt 111. Similarly, the developer images of the second to fourth process cartridges PM, PC, and PK are superimposed on the transfer belt 111 to form an unfixed 4-full color developer image.

The recording medium S stored in the feeding tray 121 is fed at a predetermined control timing. The 4-full color developer image on the transfer belt 111 is collectively transferred to the surface of the recording medium S introduced to the secondary transfer portion N2.

The recording medium S is separated from the surface of the transfer belt 111 and introduced into the fixing unit 130. The recording medium S is heated and pressed in a fixing nip portion. This fixes the developer image onto the recording medium S. Thereafter, the recording medium S to which the developer image is fixed is conveyed to the discharge tray 100*b* to end the full color image forming operation.

Figure 5:
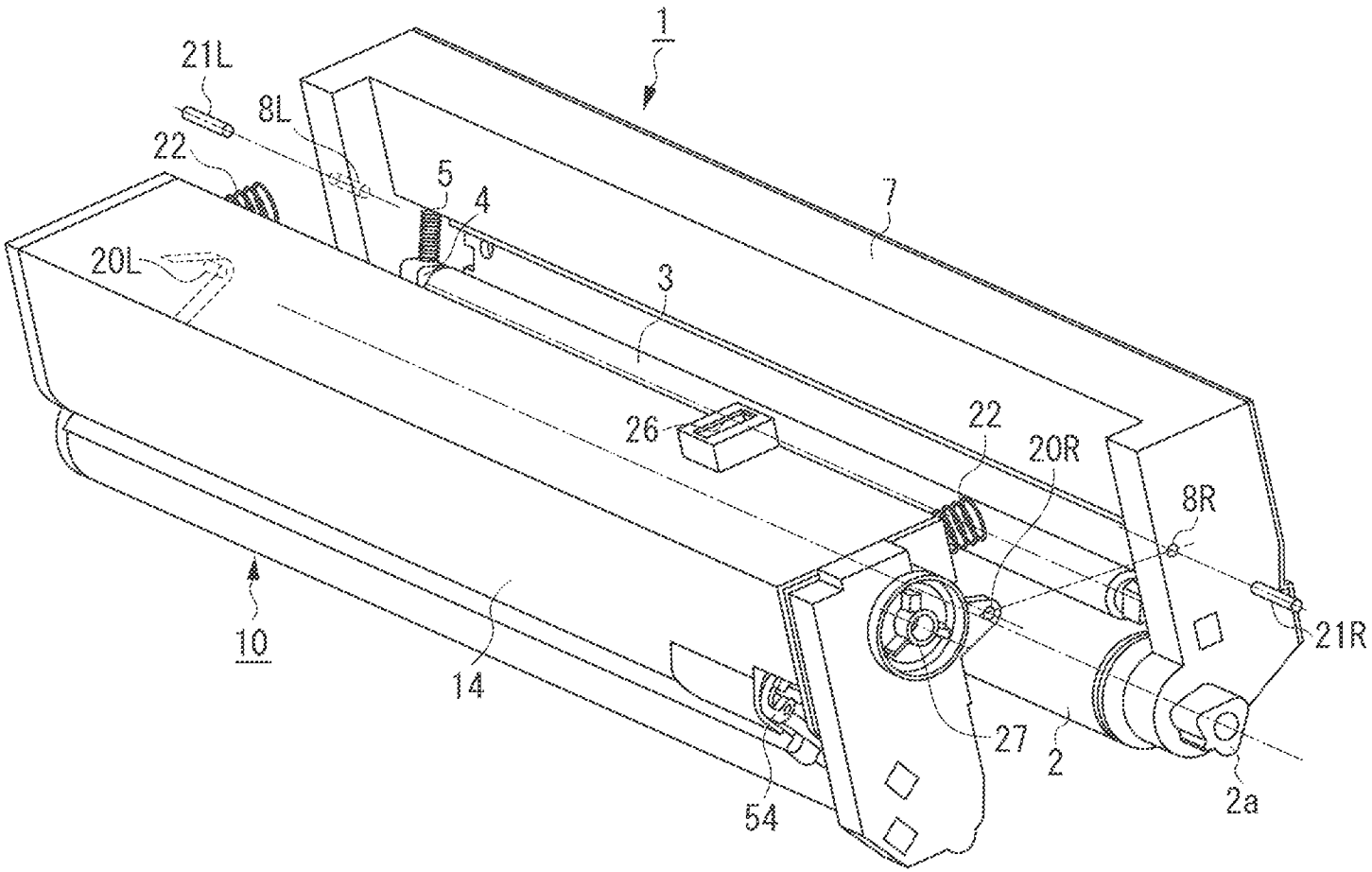
FIG. 5 is an overall perspective view of the process cartridge according to the present exemplary embodiment.

The general configuration of the process cartridge P is described below with reference to FIGS. 3, 4, and 5. FIG. 3 is a main cross sectional view of the process cartridge and the developer replenishment cartridge. FIG. 4 is an overall perspective view of the process cartridge and the developer replenishment cartridge in the main assembly. FIG. 5 is an overall perspective view of the process cartridge.

First, the cleaning unit 1 is described below. The cleaning unit 1 includes a cleaning frame member 7 having the photosensitive drum 2, the charging roller 3, and the cleaning member 6.

The photosensitive drum 2 is rotatably supported by the cleaning frame member 7. As illustrated in FIG. 4, a drum drive coupling 2*a* is provided at one end of the photosensitive drum 2. The photosensitive drum 2 and the drum drive coupling 2*a* are integrally formed.

The drum drive coupling 2*a* engages with a coupling (not illustrated) of the main assembly 100A. The driving force of a drive motor (not illustrated) of the main assembly 100A is transmitted to the drum drive coupling 2*a* drives and rotates the photosensitive drum 2 at a predetermined speed in the direction indicated by the arrow A in FIG. 3.

The charging roller 3 is driven and rotated while contacting the photosensitive drum 2. As illustrated in FIG. 3, the charging roller 3 is attached to the cleaning frame member 7 via a charging roller bearing 4. The charging roller 3 is attached movably in the direction indicated by an arrow E along a line connecting the rotation center of the charging roller 3 with that of the photosensitive drum 2.

A rotation shaft 3*a* of the charging roller 3 is rotatably supported by the charging roller bearing 4. The charging roller bearing 4 is urged against the photosensitive drum 2 by a charging roller pressure member 5.

The cleaning member 6 is formed of an elastic rubber blade 6*a* attached to the leading edge of the cleaning member 6 and a supporting sheet metal 6*b*. The leading edge of the cleaning member 6 abuts on the photosensitive drum 2 in the direction opposite to the direction in which the photosensitive drum 2 rotates.

The cleaning member 6 removes developer residues remaining on the photosensitive drum 2. The developer removed from the circumferential surface of the photosensitive drum 2 by the cleaning member 6 is stored in a removed developer storage portion 7*a*.

Next, the developing unit 10 is described below. As illustrated in FIG. 3, the developing unit 10 includes the development container 14 supporting various elements in the developing unit 10. The development container 14 is separated into a development unit 16 and the developer storage unit 15.

The development unit 16 includes a development roller 11 as a developer bearing member, a developer supply roller 12 (hereinafter referred to as "supply roller") and a development blade 13. The development roller 11 contacts the photosensitive drum 2 to rotate in the direction indicated by an arrow D.

The supply roller 12 rotates in the direction indicated by an arrow F while contacting the development roller 11. The supply roller 12 has two roles: one is to supply the developer onto the development roller 11; and the other is to remove developer residues on the development roller 11. The development blade 13 contacts the circumferential surface of the development roller 11 to regulate the thickness of the developer on the development roller 11.

Next, the combination of the cleaning unit 1 and the developing unit 10 is described below. As illustrated in FIG. 5, the cleaning frame member 7 has a cleaning connection hole 8 (8R and 8L). As illustrated in FIG. 3, a development container 14 is provided with a development side plate 19 (19R and 19L) at both ends in the longitudinal direction of the development container 14.

The development side plate 19 (19R and 19L) has a development combination hole 20 (20R and 20L). As illustrated in FIG. 5, the cleaning connection hole 8 (8R and 8L) and the development combination hole 20 (20R and 20L) engage with a combination shaft 21 (21R and 21L), thereby the cleaning unit 1 is swingably combined with the development unit 10.

As illustrated in FIG. 3, a pressure spring 22 is interposed between the cleaning unit 1 and the development unit 10. The development unit 10 acquires a rotation moment in the direction indicated by an arrow G with the development combination hole 20 as a center by an urging force of the pressure spring 22. This causes the development roller 11 to abut on the photosensitive drum 2.

In the present exemplary embodiment, the development roller 11 is arranged with contacting the photosensitive drum 2, however, the development roller 11 may be arranged at a predetermined interval.

Figure 6:
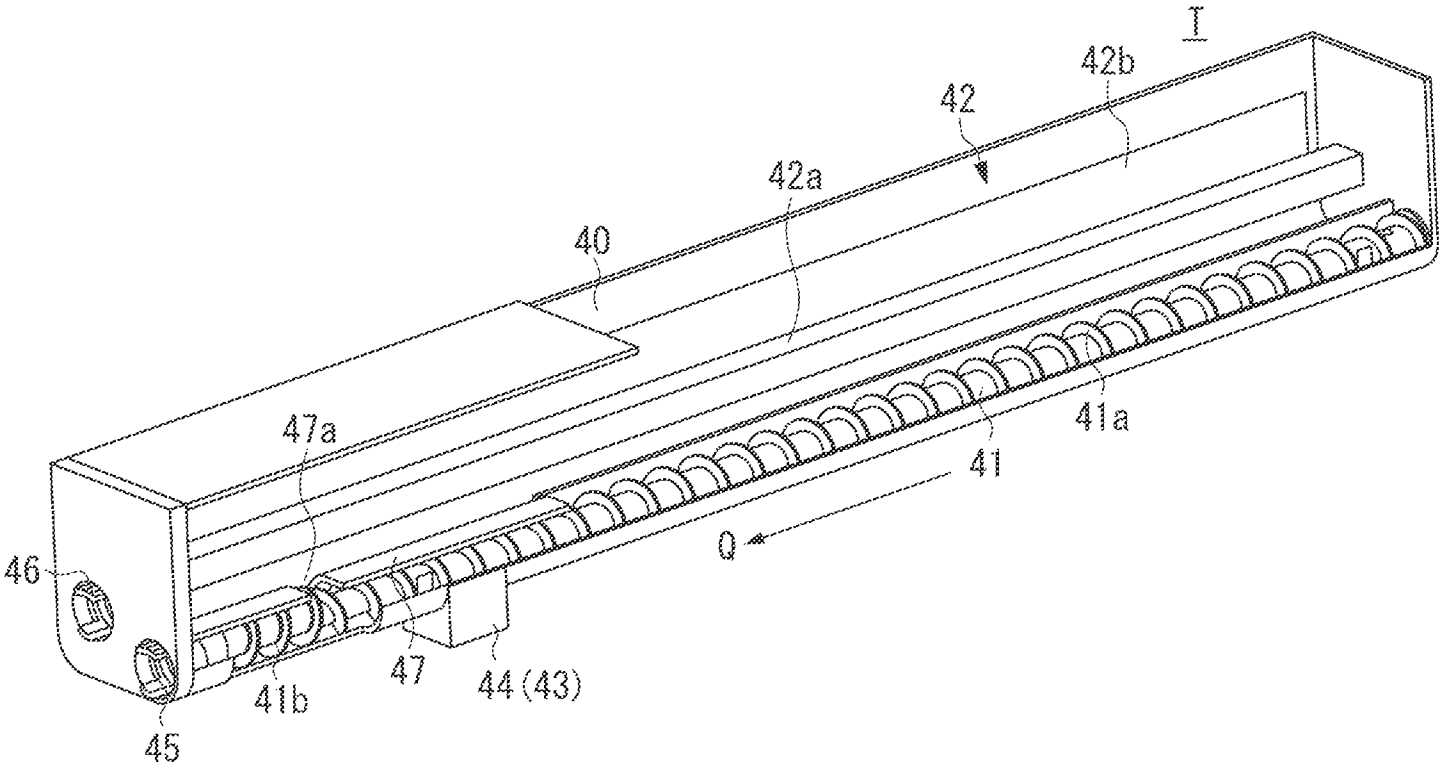
FIG. 6 is a perspective view illustrating a configuration of the developer replenishment cartridge according to the present exemplary embodiment.

The configuration of the developer replenishment cartridge TC is described below with reference to FIGS. 3 and 6. FIG. 3 is a main cross sectional view of the process cartridge and the developer replenishment cartridge. FIG. 6 is a perspective view illustrating a configuration of the developer replenishment cartridge TC.

As illustrated in FIG. 3, the developer replenishment cartridge TC includes the replenishment frame member 40 for storing the developer. The replenishment frame member 40 includes the developer replenishment opening 43 for replenishing the process cartridge P with the developer.

A developer replenishment shutter 44 is provided at the bottom part of the developer replenishment opening 43. The developer replenishment shutter 44 is normally closed, but opened when the process cartridge P and the developer replenishment cartridge TC are attached to the main assembly 100A.

The replenishment frame member 40 includes therein a replenishment conveyance member 41 and a replenishment stirring member 42. The replenishment conveyance member 41 and the replenishment stirring member 42 are rotatably supported by the replenishment frame member 40. The replenishment conveyance member 41 conveys the developer in the replenishment frame member 40 to the developer replenishment opening 43.

As illustrated in FIG. 6, the replenishment conveyance member 41 is a screw member on the surface of which a spiral fin 41*a* and a return fin 41*b* are formed. The fin 41*a* conveys the developer in the direction indicated by an arrow Q. The return fin 41*b* conveys the developer in the opposite direction.

A cover member 47 is provided above the replenishment conveyance member 41. The cover member 47 covers the developer replenishment opening 43 and a part of the replenishment conveyance member 41 in the longitudinal direction thereof. The cover member 47 is provided with a return hole 47*a*.

The replenishment stirring member 42 has two roles: one is to stir the developer in the replenishment frame member 40; the other is to convey the stirred developer to the replenishment conveyance member 41. The replenishment stirring member 42 is formed of a replenishment stirring portion 42*a* and a replenishment stirring sheet 42*b*.

A replenishment conveyance coupling 45 and a replenishment stirring coupling 46 are provided at one end of the replenishment conveyance member 41 and the replenishment stirring member 42 in the longitudinal direction thereof, respectively. The replenishment conveyance coupling 45 and the replenishment stirring coupling 46 engage with a coupling (not illustrated) of the main assembly 100A.

The driving force of a drive motor (not illustrated) of the main assembly 100A is transmitted to the replenishment conveyance coupling 45 and the replenishment stirring coupling 46 to rotate the replenishment conveyance member 41 and the replenishment stirring member 42 at a predetermined speed.

The conveyance of the developer in the developer replenishment cartridge TC is described below. The developer in the replenishment frame member 40 is stirred by the replenishment stirring member 42 and sent to the replenishment conveyance member 41. When the developer sent to the replenishment conveyance member 41 is conveyed to the cover member 47, the cover member 47 regulates apart of the developer. Thereby, the amount of the developer discharged from the developer replenishment opening 43 is kept constant.

The developer conveyed into the cover member 47 is discharged from the developer replenishment opening 43 to the process cartridge P. The developer which is not discharged from the developer replenishment opening 43 is sent from the return hole 47*a* to the replenishment stirring member 42 by the return fin 41*b* and stirred again.

Figure 7:
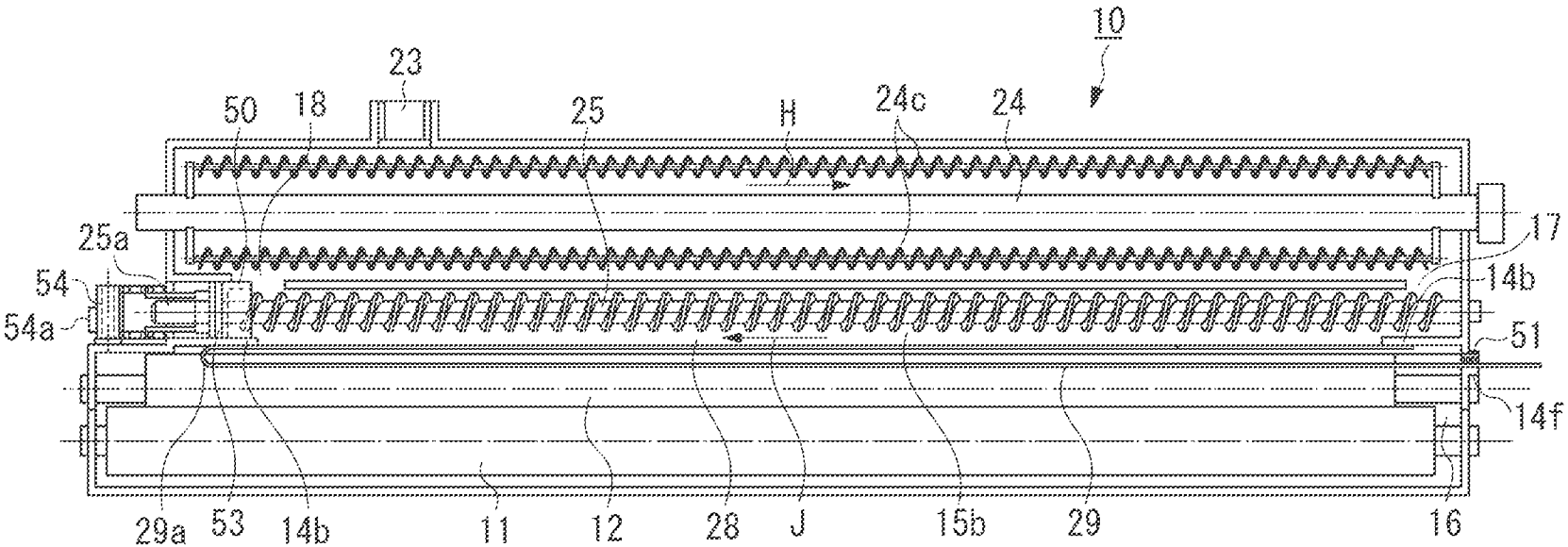
FIG. 7 is a schematic cross sectional view illustrating a configuration of a development unit according to the present exemplary embodiment.

Next, the configuration of the developer storage unit 15 is described below with reference to FIGS. 3 and 7. FIG. 7 is a schematic cross sectional view illustrating a configuration of the development unit.

The developer storage unit 15 is separated into a first storage unit 15*a* and a second storage unit 15*b* by a wall 14*a* provided on the development container 14. The first storage unit 15*a* communicates with the second storage unit 15*b* through a first opening 17 and a second opening 18 which are provided on both ends of the wall 14*a* in the longitudinal direction thereof.

The first storage unit 15*a* is provided with the developer acceptance opening 23. A developer acceptance shutter 26 is arranged at an upper portion of the developer acceptance opening 23. The developer acceptance shutter 26 is normally closed, but opened when the process cartridge P and the developer replenishment cartridge TC are attached to the main assembly 100A.

The first storage unit 15*a* is provided with a developer stirring member 24. The developer stirring member 24 has two roles: one is to mix the developer in the developer storage unit 15 with the developer replenished from the developer replenishment cartridge TC: and the other is to convey the mixed developer in the direction indicated by an arrow H. The developer stirring member 24 is configured in such a manner that a stirring spring 24*c* is attached to development support shafts 24*b* provided around a development stirring shaft 24*a*.

The second storage unit 15*b* includes a developer conveyance member 25 therein. The developer conveyance member 25 is a screw member for conveying the developer in the direction indicated by an arrow J.

As illustrated in FIG. 7, the wall 14*a* of the development container 14 is a U-shaped wall having an outer diameter of the developer conveyance member 25 and a predetermined space, and allows the developer conveyance member 25 to surely convey the developer.

A wall 14*b* of the development container 14 forming the second storage unit 15*b* extends all over the development container 14 in the longitudinal direction thereof and a development opening 28 which is a communication portion with the development unit 16 is provided at the center portion in the longitudinal direction of the development container 14. The development opening 28 is an opening portion for supplying toner from the second storage unit 15*b* of the developer storage unit 15 to the development unit 16.

The development opening 28 is sealed with a sealing member 29 when the process cartridge P is not yet used. The sealing member 29 prevents the developer storage unit 15 from leaking the developer when the process cartridge P is transported. The sealing member 29 is bonded to the entire circumference of the development opening 28 by means of welding. One end of the sealing member 29 in the longitudinal direction thereof is folded back at a fold-back portion 29*a*, passes through a seal opening 14*f* provided on the development container 14 and extends outside the development container 14.

A seal member 51 is provided on the seal opening 14*f*. The seal member 51 prevents the seal opening 14*f* from leaking the developer. An end 29*b* of the sealing member 29 in the longitudinal direction thereof is coupled with a take-up member 38 outside the development container 14. When the process cartridge P is used, the sealing member 29 is taken up by the take-up member 38 and removed.

The conveyance of the developer in the developing unit 10 is described below. The developer replenished from the developer replenishment cartridge TC via the developer acceptance opening 23 is mixed with the developer in the developer storage unit 15 in the first storage unit 15*a* by the developer stirring member 24.

The mixed developer passes through the first opening 17 and is sent to the second storage unit 15*b*. In the second storage unit 15*b*, the developer is conveyed from the development opening 28 to the development unit 16 by the developer conveyance member 25. The developer conveyed to the development unit 16 is sent from the developer supply roller 12 to the development roller 11 and developed.

The developer which is not used for development is returned again from the development unit 16 to the second storage unit 15*b*. Thereafter, the developer is conveyed from the second opening 18 to the first storage unit 15*a* by the developer conveyance member 25.

Figure 8:
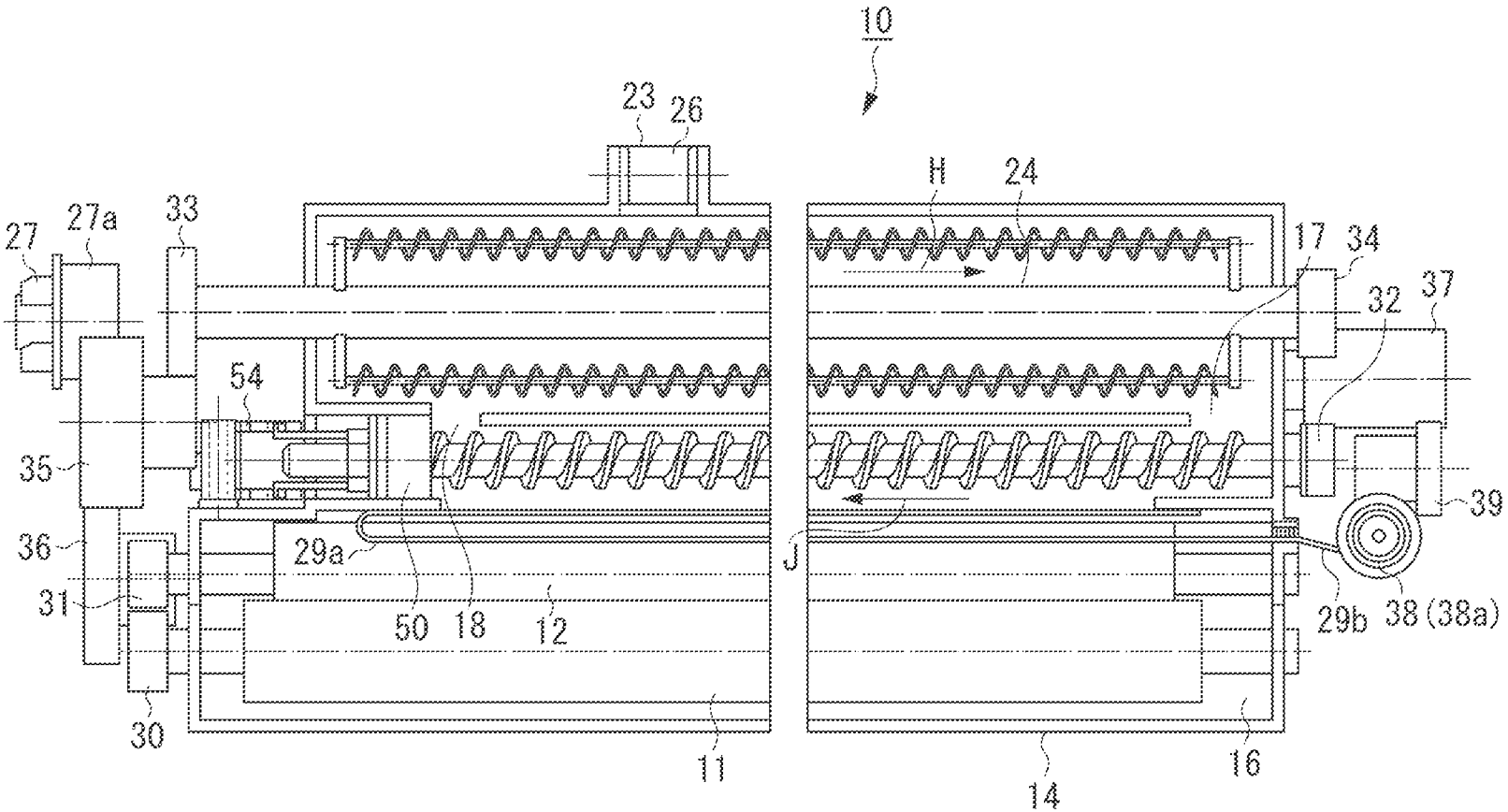
FIG. 8 is a schematic cross sectional view illustrating a configuration of a drive train of a developing unit according to the present exemplary embodiment.

Next, the driving configuration of the developing unit 10 is described below with reference to FIGS. 5 and 8. FIG. 5 is an overall perspective view of the process cartridge P. FIG. 8 is schematic cross sectional view illustrating a configuration of a drive train of the developing unit 10.

As illustrated in FIG. 8, a development roller drive gear 30 for transmitting the driving force to the development roller 11 is provided at one end of the development roller 11. A supply roller drive gear 31 for transmitting the driving force to the supply roller 12 is provided at one end of the supply roller 12.

A development conveyance gear 32 for transmitting driving force to the developer conveyance member 25 is provided at one end of the developer conveyance member 25. A first development stirring gear 33 for transmitting driving force to the developer stirring member 24 is provided at one end of the developer stirring member 24. A second development stirring gear 34 for transmitting driving force to the developer stirring member 24 is provided at the other end of the developer stirring member 24.

As illustrated in FIGS. 5 and 8, a development drive coupling 27 is provided at one end of the developing unit 10 in the longitudinal direction thereof. The development drive coupling 27 engages with a coupling (not illustrated) of the main assembly 100A. The development drive coupling 27 rotates at a predetermined speed when the driving force of a drive motor (not illustrated) of the main assembly 100A is transmitted thereto.

The driving force of the drive motor of the main assembly 100A is transmitted from the development drive coupling 27 via the following path.

As illustrated in FIG. 8, the driving force of the development drive coupling 27 is transmitted from a gear portion 27*a* of the development drive coupling 27 to the development roller drive gear 30 and the supply roller drive gear 31 via a first idler gear 35 and a second idler gear 36. This drives and rotates the development roller 11 and the developer supply roller 12.

The drive of the first idler gear 35 is also transmitted to the first development stirring gear 33 to drive the developer stirring member 24. The driving force of the developer stirring member 24 is transmitted from the second development stirring gear 34 to the development conveyance gear 32 via a third idler gear 37 to drive and rotate the developer conveyance member 25.

The driving force of the third idler gear 37 is also transmitted to a fourth idler gear 39. The driving force of the fourth idler gear 39 is transmitted to a take-up gear portion 38*a* provided on the take-up member 38 to drive and rotate the take-up member 38. Thereby, the sealing member 29 is taken up and removed from the development opening 28.

Accordingly, when the driving force is transmitted from the main assembly 100A to the unused process cartridge P, the developer stirring member 24 and the developer conveyance member 25 are rotated, and taking up of the sealing member 29 is started at the same time. However, a sealing area of the sealing member lies around the development opening 28, so that the development opening 28 is opened a predetermined time after the developer is started to be stirred and conveyed by the transmission of the driving force, and the developer is replenished into the development unit 16.

Figure 1:
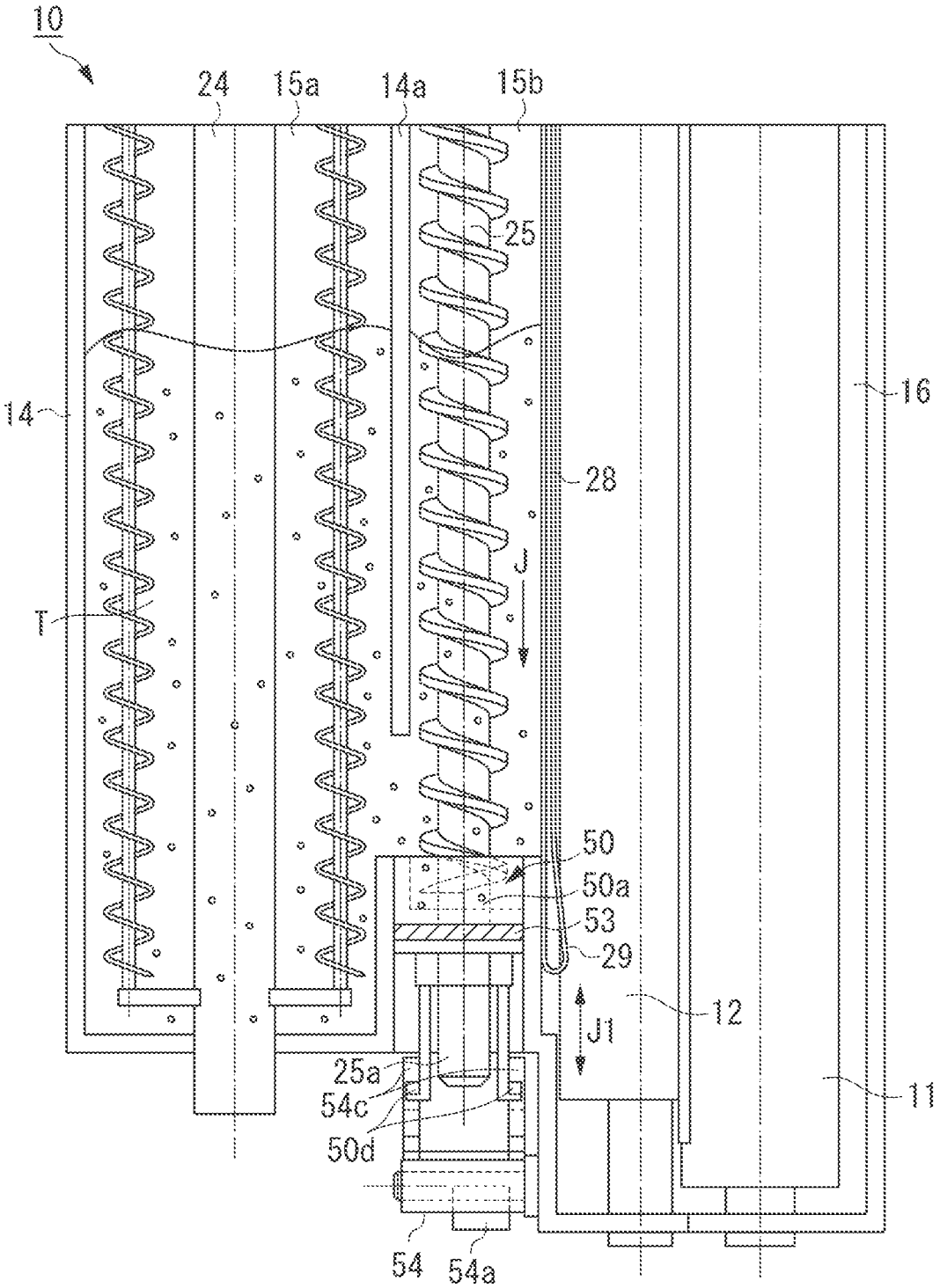
FIG. 1 is a schematic cross sectional view illustrating a state after an unused process cartridge is transported according to an exemplary embodiment of the present invention.
Figure 9:
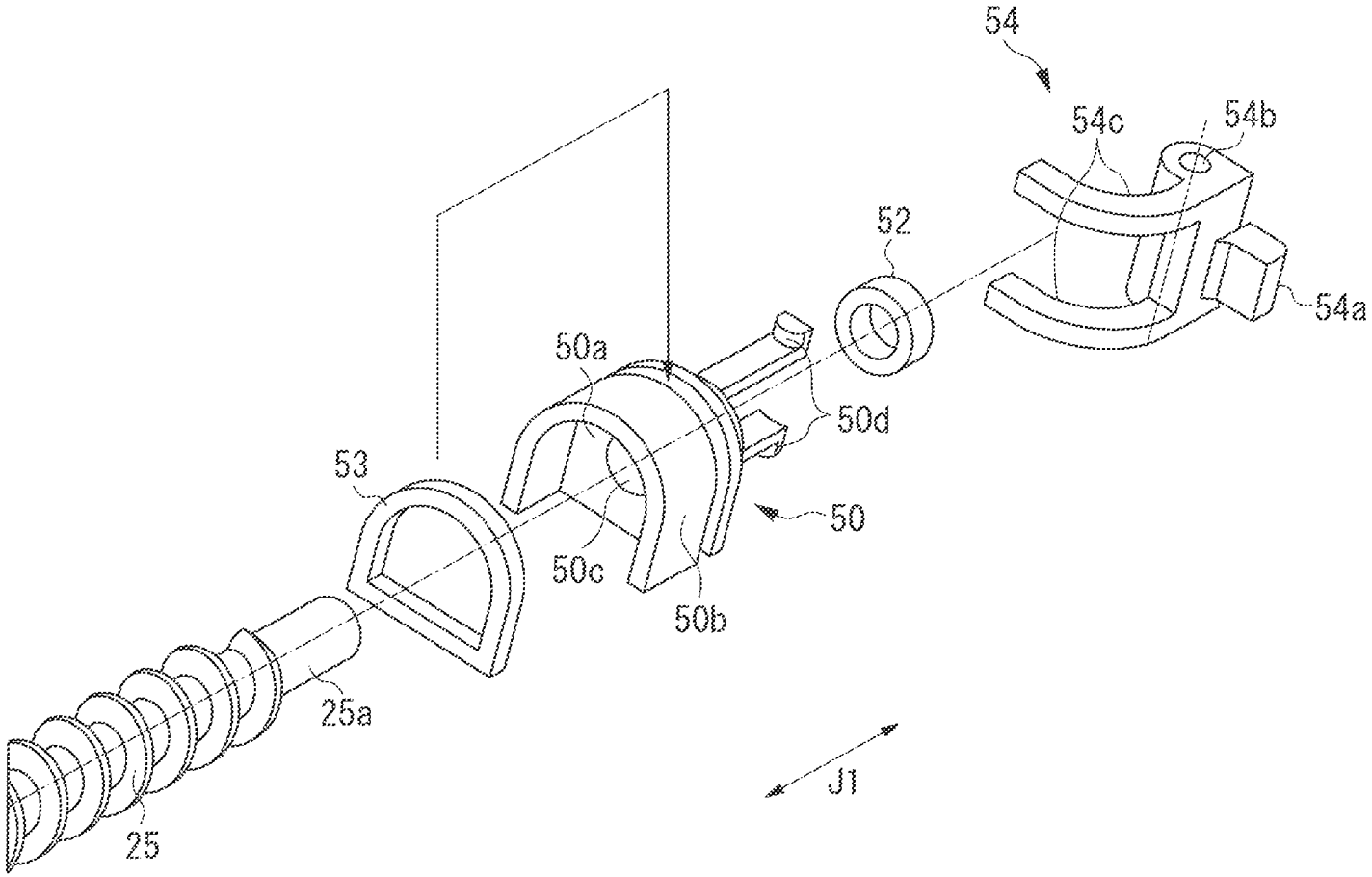
FIG. 9 is an exploded perspective view illustrating a configuration of a partitioning member according to the present exemplary embodiment.
Figure 10:
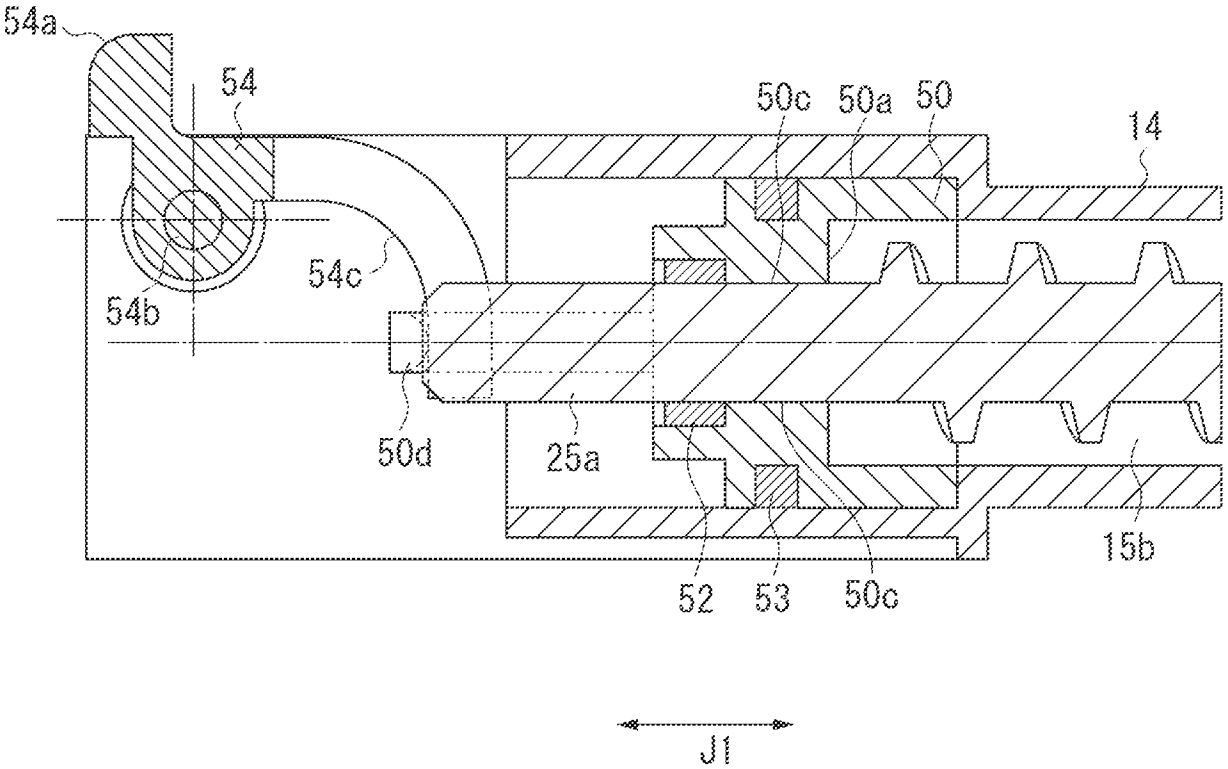
FIG. 10 is a partial cross sectional view illustrating an unused process cartridge according to the present exemplary embodiment.
Figure 11:
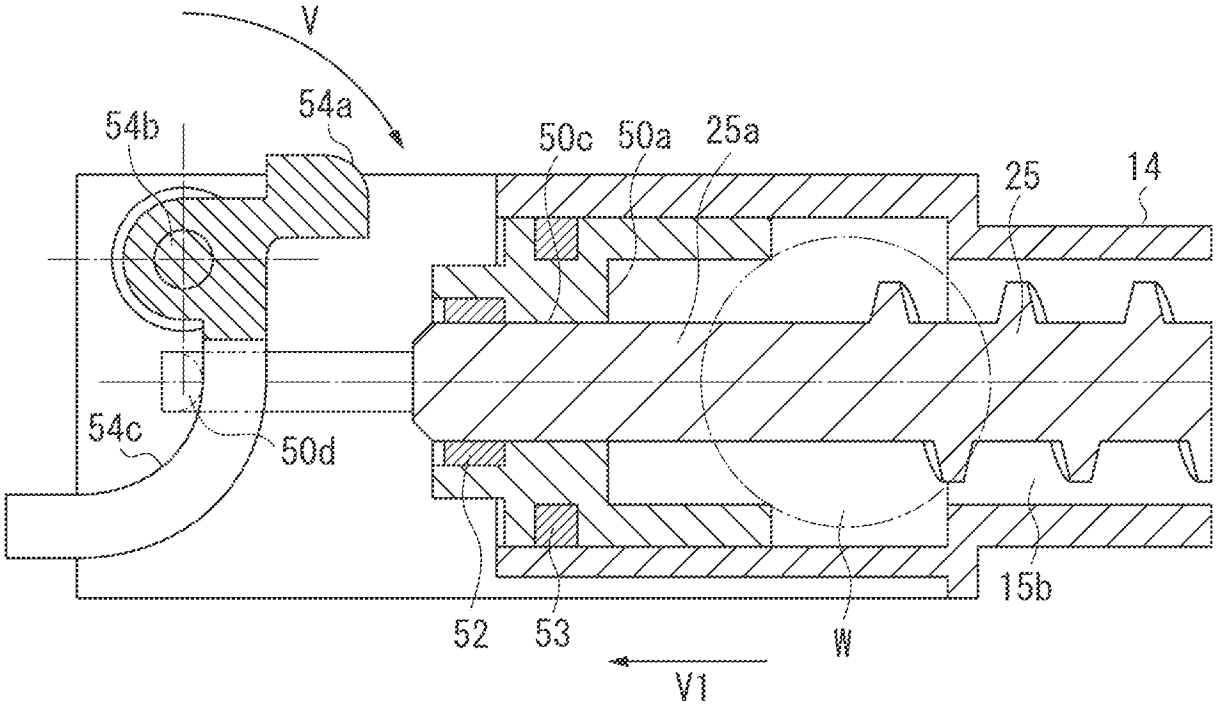
FIG. 11 is a partial cross sectional view illustrating a state after the process cartridge is attached to the image forming main assembly according to the present exemplary embodiment.
Figure 12:
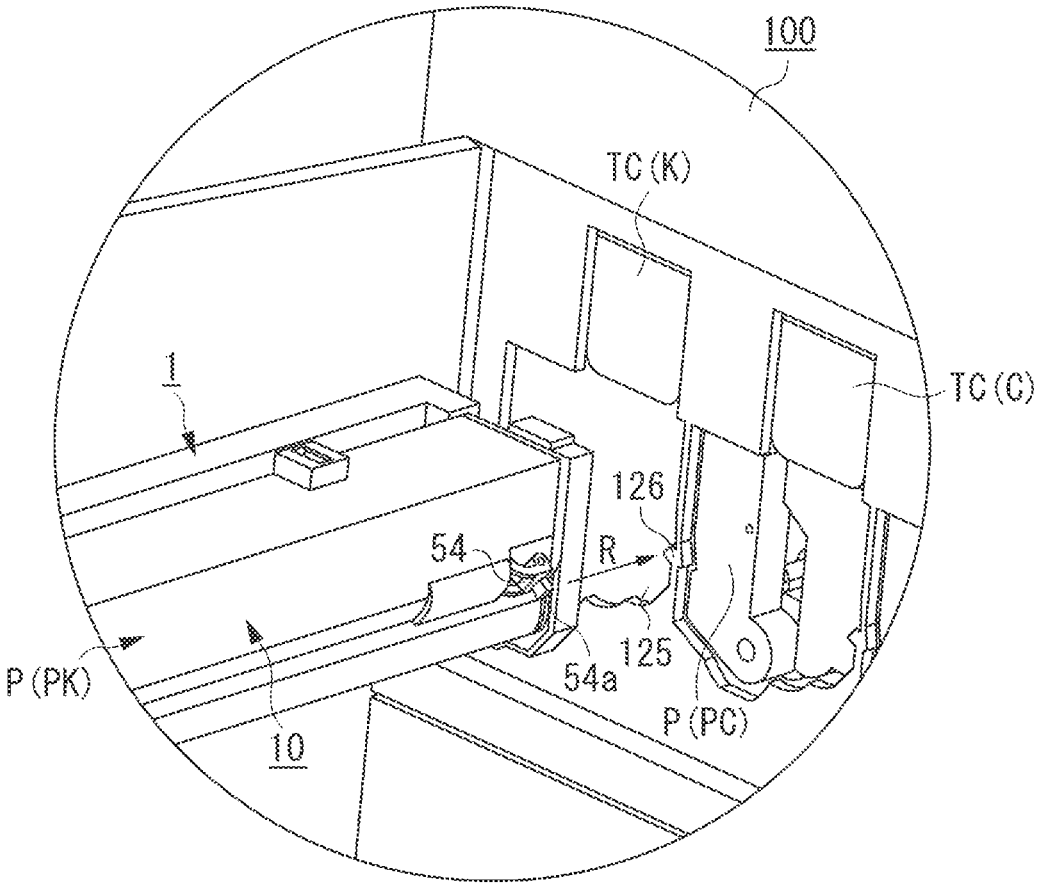
FIG. 12 is a perspective view illustrating a method for attaching the process cartridge to the image forming main assembly according to the present exemplary embodiment.

The release of coagulation of the developer, which is the principal part of the present invention, is described below. FIG. 1 is a schematic cross sectional view illustrating a configuration of a development unit on the downstream side in the conveyance direction of the conveyance member. FIG. 9 is an exploded perspective view illustrating a configuration of a partitioning member. FIG. 10 is a partial cross sectional view illustrating an unused process cartridge. FIG. 11 is a partial cross sectional view illustrating a state where the unused process cartridge is attached to the main assembly 100A. FIG. 12 is a perspective view illustrating the state where the process cartridge is attached to the main assembly 100A.

As illustrated in FIG. 1, there is provided a partitioning member 50 which engages with an area surrounded by the walls 14*a* and 14*b* of the development container 14 forming the second storage unit 15*b* on the downstream side in the conveyance direction J of the developer conveyance member 25. The partitioning member 50 forms one end of the second storage unit 15*b*.

As illustrated in FIGS. 9 and 10, the partitioning member 50 includes a partition wall portion 50*a* for partitioning the second storage unit 15*b* and a guide surface 50*b* provided around the partition wall portion 50*a*. The guide surface 50*b* has such a dimension that the guide surface 50*b* engages with the walls 14*a* and 14*b* of the development container 14. The partitioning member 50 is movable in the area in the direction of the shaft of the developer conveyance member 25 (in the direction indicated by an arrow J1 in FIG. 10).

The partitioning member 50 is provided with a bearing portion 50*c* for rotatably supporting a shaft 25*a* of the developer conveyance member 25. The bearing portion 50*c* is provided with an opening. The shaft 25*a* passes through the bearing portion 50*c*. A sealing member 52 for sealing the shaft 25*a* of the developer conveyance member 25 is provided in the vicinity of the bearing portion 50*c*. A circumferential sealing member 53 for performing seal from the development container 14 is provided on the guide surface 50*b*.

It is preferable that the sealing member 52 and the circumferential sealing member 53 are lip-shaped material using expandable urethane foam, flexible resin such as elastomer, or rubber, for example.

The development container 14 of the process cartridge P is provided with a lever 54 (a rotation member) acting as an operated member subjected to action when the process cartridge P is attached to the main assembly 100A. The lever 54 is formed of an operated portion 54*a* contacting the main assembly 100A and an engaging portion 54*c* engaging with a rotation fulcrum 54*b* and an engaging portion 50*d* of the partitioning member 50 to move the partitioning member 50.

The lever 54 and the partitioning member 50 are described below. As illustrated in FIG. 10, the partitioning member 50 is held in an illustrated position (a first position) when the process cartridge is not yet used. In other words, the partition wall portion 50*a* of the partitioning member 50 is positioned on the upstream side in the conveyance direction of the developer conveyance member 25.

The operated portion 54*a* of the lever 54 is held in a position where the operated portion 54*a* protrudes from the outer contour of the development container 14 so that the operated portion 54*a* can act on the main assembly 100A.

In the present exemplary embodiment, the process cartridge P is attached to the main assembly 100A in such a manner that the process cartridge P is inserted in the direction of the shaft line of the photosensitive drum 2 as indicated by an arrow R in FIG. 12. The main assembly 100A is provided with an opening guide 125 acting as an attachment guide portion for attaching the process cartridge P to facilitate attaching the process cartridge P.

The opening guide 125 has a space substantially equal to the contour of the process cartridge P. A user attaches or detaches the process cartridge P to or from the main assembly 100A along the shape of the opening guide 125.

At the periphery of the opening guide 125, there is provided an operation portion 126 which touches the above protruded operated portion 54*a* of the lever 54 at the time of attaching the process cartridge P to rotate the lever 54 by the attaching operation of the process cartridge P.

For this reason, when the unused process cartridge P is attached to the main assembly 100A by a predetermined amount along a locus indicated by the arrow R, the operation portion 126 touches the lever 54.

Thereafter, when the process cartridge P is further inserted, the lever 54 is rotated in the direction indicated by an arrow V in FIG. 11 according to the position of the process cartridge P. Then, the engaging portion 54*c* is moved with the rotation of the lever 54 to pull the engaging portion 50*d* of the partitioning member 50, moving the partitioning member 50 to the downstream side in the conveyance direction of the developer conveyance member 25 (in the direction indicated by an arrow V1 in FIG. 11).

When the process cartridge P is fully inserted into a predetermined position in the main assembly 100A, i.e., into a position where an image can be formed, the partitioning member 50 reaches a position illustrated in FIG. 11 (a second position). A space W is formed according to the amount of movement in which the partitioning member 50 is moved from a first position (refer to FIG. 10) to the second position in the second storage unit 15*b* of the developer storage unit 15.

More specifically, the process cartridge P is attached to the main assembly 100A to move the partitioning member 50 from the first position (refer to FIG. 10) to the downstream side in the developer conveyance direction of the developer conveyance member 25 (in the direction indicated by the arrow V1 in FIG. 11). The partitioning member 50 reached the second position (refer to FIG. 11) makes the capacity of the developer storage unit 15 (the second storage unit 15*b*) larger than that of the developer storage unit 15 in the first position by the space W.

Here, a case where one process cartridge P is transported is described.

When the process cartridge P is transported, its orientation can be arbitrarily selected by the user. As illustrated in FIG. 1, the process cartridge P may sometimes be transported with the upstream side of the developer conveyance member 25 pointing upward. As described above, since the developer storage unit 15 of the unused process cartridge P is filled with a predetermined amount of the developer T, if the process cartridge P is transported with the upstream side pointing upward, the developer T is accumulated only on the downstream side in the conveyance direction of the developer conveyance member 25. The developer T is sometimes coagulated by vibration in transportation.

In the configuration of the present exemplary embodiment, even in such a state, attaching the process cartridge P to the main assembly 100A moves the partitioning member 50 by a predetermined amount from the upstream side (the first position) in the conveyance direction of the developer conveyance member 25 to the downstream side (the second position) in the conveyance direction thereof. At this moment, the developer T flows into the space W produced by the movement of the partitioning member 50 to reduce coagulation.

Even in a time period until the sealing member 29 is opened after the process cartridge P started to be driven, the developer can be prevented from being pressed, and the increase in a load torque can be inhibited.

In the present exemplary embodiment, the operated portion is operated by the operation that the user attaches the process cartridge P to the main assembly 100A to move the partitioning member 50. Driving force from the main assembly 100A is not used for moving the partitioning member 50, so that a load for moving the partitioning member 50 is not applied to the main assembly 100A.

On the other hand, when the user attaches the process cartridge P to the main assembly 100A, a force for operating the operated portion 54*c* is required. Then, in the present exemplary embodiment, the operated portion 54*c* is provided on the rotatable lever 54. The principle of leverage is applied to allow the reduction of a force for operating the operated portion 54*c*.

More specifically, as illustrated in FIG. 11, a distance between the operated portion 54*a* and the rotation fulcrum 54*b* of the lever 54 is made greater than a distance between the engaging portion 54*c* engaging with the partitioning member 50 and the rotation fulcrum 54*b*. Thereby, force rotating the lever 54 by operating the operated portion 54*a* is decreased to allow inhibiting load on the user.

The partitioning member 50 has an opening, through which the shaft 25*a* of the developer conveyance member 25 passes, in the bearing portion 50*c* to allow the partitioning member 50 to be moved with respect to the shaft 25*a*. This enables the partitioning member 50 to be smoothly moved along the shaft 25*a* from the first position to the second position. This can decrease the force which needs to be applied to the operated portion 54*a* of the lever 54 to move the partitioning member 50.

When the process cartridge P is driven and a predetermined time period elapses, the sealing member 29 is opened, and the developer is moved through the development opening 28 to the development unit 16. In this state, the developer conveyance member 25 supplies the developer to the developer supply roller 12 and the development roller 11 to enable the formation of an image.

As described above, the process cartridge P is provided with the partitioning member 50 and the operated portion 54*a* and the partitioning member 50 is moved by the operation for attaching the process cartridge P to allow producing a space inside the developer storage unit 15.

Thereby, even in the unused process cartridge P and the developer therein is coagulated on the downstream side in the conveyance direction of the developer conveyance member 25, a load torque for driving the developer conveyance member 25 immediately after driving is started can be prevented from increasing.

The present invention is not limited to the present exemplary embodiment, and the arrangement of each component and the materials to be used may be appropriately changed. The present invention may be applied not only to the process cartridge, but also to a developer replenishment cartridge storing only a developer or to a cartridge in which the process cartridge is integrated with the developer replenishment cartridge.

In the present exemplary embodiment, the operation portion 126 is provided on the opening guide 125 of the main assembly 100A, however, the present invention is not limited to this exemplary embodiment. For example, the operation portion 126 may be provided separated from the opening guide 125 in the vicinity of a process cartridge attaching path.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-249920 filed Nov. 15, 2011, which is hereby incorporated by reference herein in its entirety.

What is claimed is:

1. A cartridge detachably mountable to a main assembly of an image forming apparatus, the cartridge comprising:

a developer storage unit configured to store developer;

a partitioning member movably provided inside the developer storage unit and configured to partition the developer storage unit;

a developer conveyance member configured to convey the developer stored in the developer storage unit; and an operated portion configured to move the partitioning member;

wherein when the cartridge is attached to the main assembly, the operated portion is moved by touching the main assembly to move the partitioning member from a first position to a second position where the developer storage unit is caused to be greater in capacity than that in the first position, and wherein the second position is located on a downstream side of the first position in the developer conveyance direction in which the developer conveyance member conveys the developer.

2. The cartridge according to claim 1, wherein when the cartridge is attached to the main assembly, the operated portion is moved along a rotation axis of the developer conveyance member.

3. The cartridge according to claim 1, wherein the developer conveyance member passes through the partitioning member, and the partitioning member is moved from the first position to the second position along the developer conveyance member.

4. The cartridge according to claim 1, further comprising a rotation member configured to be rotatable and engage with the partitioning member, and wherein the operated portion is provided on the rotation member, a distance between the operated portion and the rotation fulcrum of the rotation member is greater than a distance between the engaging portion of the rotation member engaging with the partitioning member and the rotation fulcrum.

5. The cartridge according to claim 1, wherein the developer conveyance member conveys the developer in the direction along the rotation shaft thereof.

6. The cartridge according to claim 1, further comprising a developer bearing member configured to carry developer supplied from the developer storage unit.

7. The cartridge according to claim 1, further comprising:

an image bearing member on which an electrostatic latent image is formed; and a developer bearing member configured to carry developer supplied from the developer storage unit, and develop the electrostatic latent image.

8. An image forming apparatus for forming images, the image forming apparatus comprising:

a main assembly including an operation portion; and a cartridge detachably mountable to the main assembly, wherein the cartridge includes:

a developer storage unit configured to store developer;

a partitioning member movably provided inside the developer storage unit and configured to partition the developer storage unit;

a developer conveyance member configured to convey the developer stored in the developer storage unit; and an operated portion configured to move the partitioning member, wherein when the cartridge is attached to the main assembly, the operated portion is moved by touching the operation portion to move the partitioning member from a first position to a second position where the developer storage unit is caused to be greater in capacity than that in the first position, and wherein the second position is located on a downstream side of the first position in the developer conveyance direction in which the developer conveyance member conveys the developer.

9. The image forming apparatus according to claim 8, wherein the operated portion is moved by touching the operation portion, and the partitioning member is moved, along a rotation axis of the developer conveyance member, from a first position to a second position where the developer storage unit is caused to be greater in capacity than that in the first position.

10. The image forming apparatus according to claim 8, wherein the developer conveyance member passes through the partitioning member, and the partitioning member is moved from the first position to the second position along the developer conveyance member.

11. The image forming apparatus according to claim 8, wherein the cartridge further comprises a rotation member configured to be rotatable, and engage with the partitioning member, and wherein the rotation member is provided with the operated portion, and a distance between the operated portion and the rotation fulcrum of the rotation member is greater than a distance between the engaging portion of the rotation member engaging with the partitioning member and the rotation fulcrum.

12. The image forming apparatus according to claim 8, wherein the developer conveyance member conveys the developer in the direction along the rotation shaft thereof.

13. The image forming apparatus according to claim 8, the cartridge further comprising a developer bearing member configured to carry a developer supplied from the developer storage unit.

14. The image forming apparatus according to claim 8, the cartridge further comprising:

an image bearing member on which an electrostatic latent image is formed; and a developer bearing member configured to carry developer supplied from the developer storage unit, and develop the electrostatic latent image.

* * * * *